US008166575B2

(12) United States Patent
Haselmayer

(10) Patent No.: US 8,166,575 B2
(45) Date of Patent: May 1, 2012

(54) PROTECTIVE HEADGEAR WITH A VISOR AND EAR MUFF

(75) Inventor: Peter Haselmayer, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 322 days.

(21) Appl. No.: 12/439,170

(22) PCT Filed: Aug. 17, 2007

(86) PCT No.: PCT/EP2007/007273

§ 371 (c)(1),
(2), (4) Date: Feb. 27, 2009

(87) PCT Pub. No.: WO2008/025460

PCT Pub. Date: Mar. 6, 2008

(65) Prior Publication Data

US 2009/0260135 A1 Oct. 22, 2009

(30) Foreign Application Priority Data

Aug. 30, 2006 (DE) ..... 10 2006 040 555

(51) Int. Cl.
*A42B 1/24* (2006.01)

(52) U.S. Cl. ..... 2/422; 2/423; 2/424; 2/10

(58) Field of Classification Search ..... 2/422, 423, 2/424, 425, 9, 10, 11, 15, 410, 209, 13, 452, 2/411, 414; 455/351
See application file for complete search history.

(56) References Cited

U.S. PATENT DOCUMENTS

| | | | | |
|---|---|---|---|---|
| 3,193,841 | A | 7/1965 | Haluska | |
| 3,461,463 | A * | 8/1969 | Beguin | 2/423 |
| 3,721,993 | A * | 3/1973 | Lonnstedt | 2/423 |
| 3,845,505 | A | 11/1974 | Davison et al. | |
| 3,946,466 | A * | 3/1976 | Sakai | 24/568 |
| 4,104,743 | A * | 8/1978 | Bottger | 2/423 |
| 4,167,043 | A * | 9/1979 | Hartig | 2/423 |
| D254,100 | S * | 2/1980 | Breger | D29/105 |
| 4,186,447 | A * | 2/1980 | Palmaer | 2/423 |
| 4,222,123 | A * | 9/1980 | Hellberg | 2/10 |
| 4,347,631 | A | 9/1982 | Newcomb | |
| 4,547,908 | A * | 10/1985 | Karlsson et al. | 2/424 |
| 4,756,028 | A * | 7/1988 | Scanlon | 2/209 |
| 5,333,329 | A * | 8/1994 | Hong | 2/424 |
| 5,546,610 | A | 8/1996 | Herzig et al. | |
| 6,125,477 | A * | 10/2000 | Crippa et al. | 2/422 |
| 6,352,383 | B1 * | 3/2002 | Ristola | 403/254 |
| 6,851,129 | B2 * | 2/2005 | Gafforio et al. | 2/424 |
| 2004/0156115 | A1 * | 8/2004 | Iori et al. | 359/642 |
| 2004/0199982 | A1 * | 10/2004 | Wang-Lee | 2/424 |

FOREIGN PATENT DOCUMENTS

| | | | |
|---|---|---|---|
| CN | 2110388 | U | 7/1992 |
| EP | 0646333 | A | 4/1995 |
| EP | 1472944 | A | 11/2004 |

* cited by examiner

*Primary Examiner* — Gary L Welch
*Assistant Examiner* — Khaled Annis
(74) *Attorney, Agent, or Firm* — Gudrun E. Huckett

(57) ABSTRACT

A protective headgear combination has a helmet and at least one ear defender secured on the helmet rotational position of the at least one ear defender relative to the helmet is adjustable about a first axis of rotation, wherein the first axis of rotation is positioned relative to the vertical at an angle of less than 45° for an upright head position of a user of the protective headgear combination.

19 Claims, 4 Drawing Sheets

PROTECTIVE HEADGEAR WITH A VISOR AND EAR MUFF

BACKGROUND OF THE INVENTION

The invention concerns a protective headgear combination comprising a helmet and comprising at least one ear defender secured on the helmet.

EP 0 646 333 B1 discloses a protective headgear combination with two ear defenders. The ear defenders are secured each on a securing bracket on the helmet of the protective headgear combination. The ear defenders can be pivoted outwardly away from the ear of the user. Moreover, the vertical position of the ear defenders on the securing bracket can be adjusted in the longitudinal direction of the securing bracket. In the operative position, the ear defender is forced by the securing bracket that is of a springy configuration against the head of the user. In case of such a holder, unsatisfactory sound damping results may be obtained depending on the shape of the head of the user.

The invention has the object to provide a protective headgear combination of the aforementioned kind that enables an excellent adjustment to the head shape of the user and with which excellent sound damping properties can be achieved.

SUMMARY OF THE INVENTION

This object is solved by a headgear combination wherein the rotational position of the ear defender relative to the helmet is adjustable about a first axis of rotation wherein the first axis of rotation is positioned relative to the vertical at an angle of less than 45° for an upright head position of the user of the protective headgear combination.

It has been found that in particular in the area behind the ear there is often only an unsatisfactory contact of the ear defender on the head of the user. Especially in this area, however, a high sound sensitivity exists.

The contact of the ear defenders on the head of the user also in the area behind the ear can be achieved by the adjustable rotational position that is being provided. An excellent adaptation to the position of the ear defender to the respective head shape of the user can be achieved. In an upright position of the head of the user, i.e., when the user is wearing the helmet conventionally on his head and keeps the head upright, the axis of rotation about which the rotational position of the ear defender is adjustable can be parallel to the vertical or can be positioned relative to the vertical at an angle that is smaller than 45°. Accordingly, an adjustability about an axis of rotation that is substantially vertically oriented is achieved. In this way, an excellent contact of the ear defender even in an area behind the ear can be adjusted.

Advantageously, the ear defender is secured by means of a securing bracket on the helmet. The first axis of rotation extends in particular approximately parallel to the longitudinal direction of the securing bracket. The longitudinal direction in this context is defined as the imaginary connecting line between the attachment of the securing bracket on the helmet and the attachment of the ear defender on the securing bracket. Advantageously, the rotational position of the ear defender relative to the securing bracket is adjustable. In this way, the function of folding away the securing bracket and adjusting the rotational position of the ear defender on the securing bracket can be embodied so as to be spatially separated so that sufficient space is available.

Advantageously, the ear defender is secured by means of a spherical bearing on the helmet. By means of the spherical bearing not only the rotational position about the first axis of rotation but also the rotational position about an axis of rotation that is perpendicular thereto can be adjusted. Moreover, the position of the ear defender on the securing bracket can be adjusted within predetermined limits forwardly and rearwardly. In this way, an excellent adjustability can be achieved. It is provided that the spherical bearing comprises a bearing plate with a spherical section as well as a releasable clamping device wherein the spherical section of the bearing plate can be secured in different positions on the securing bracket by means of the clamping device. The damping device can be easily released and secured again by the user. Accordingly, the rotational position of the ear defender relative to the securing bracket must be adjusted only once for a user. Since by means of the clamping device the relative position between ear defender and securing bracket is maintained, it is not necessary to adjust the ear defenders again when working again with the protective headgear combination. The adjustment of the securing bracket to the side or to the rear does not affect the position of the ear defender on the securing bracket.

It is provided that the ear defender on the securing bracket is pivotably arranged about a substantially horizontally positioned pivot axis when the head of the user is in upright position. In this way, in this direction an excellent automatic adjustment of the position of the ear defender to the head shape of the user is achieved. Advantageously, the position of the securing bracket relative to the helmet in the upright head position of the user is adjustable approximately in the vertical direction. This makes it possible also to provide a further adjustment possibility of the position of the ear defender relative to the helmet in relation to the head shape of the user. In that the position of the ear defender is adjustable about the axis of rotation relative to the securing bracket and the position of the securing bracket is adjustable in the vertical direction relative to the helmet, the different adjusting possibilities are spatially separated from one another so that a comparatively simple constructive design is provided.

It is provided that on the securing bracket on the end facing away from the ear defender an inner holder is arranged wherein the position of the inner holder relative to the helmet in particular for an upright head position of the user is adjustable in an approximately vertical direction. Advantageously, on the inner holder a toothing is arranged that defines different positions of the inner holder relative to the helmet. The toothing provides predetermined relative positions between securing bracket and helmet. By counting the toothings the same height of the ear defender on both sides of the helmet can be obtained. The toothing ensures at the same time that the inner holder is securely seated on the helmet.

It is provided that the securing bracket with the ear defender is adjustable relative to the helmet between an operative position in which the ear defender is arranged on the head of the user and a rest position in which the ear defender is positioned laterally spaced relative to the head of the user. The lateral spacing means a spacing from the head of the user in the outward direction, i.e., in a lateral direction relative to the head of the user. Expediently, the protective headgear combination has a holding device that secures the securing bracket in the operative position and in the rest position. In this way, the ear defender must not be held by the user in the rest position. The spacing of the ear defender relative to the head of the operator in the rest position is as small as possible so that the user, for example, when walking through underbrush will not get the ear defender caught on branches or the like. Expediently, the holding device is arranged in the inner holder. In this way, a compact configuration results. When adjusting the vertical position of the securing bracket relative to the helmet the inner holder can remain closed so that an accidental demounting of the holding device is prevented. Advantageously, the holding device comprises a spring that is embodied as an open spring ring. This spring has a simple configuration and can be mounted and demounted in a simple way. The spring ring can be designed to be comparatively large so that mounting is simplified.

It is provided that the securing bracket can be adjusted from the rest position into an inoperative position wherein the ear defender in the inoperative position is arranged in the rearward area of the helmet at a spacing to the helmet. The rearward area of the helmet in this connection is the area that is arranged at the back of the head of the user. In that the ear defender is arranged in the inoperative position at a spacing to the helmet, soiling of the ear defender by placing it onto the usually greatly soiled helmet is prevented. It is provided that the securing bracket is arranged so as to be adjustable about a second axis of rotation on the helmet for the inoperative position wherein the second axis of rotation for an upright position of the head of the user is positioned relative to the vertical at an angle of more than 45°. Advantageously, the securing bracket is secured by means of a holder on the helmet and the holder is secured relative to the helmet so as to be adjustable about the second axis of rotation. In order to ensure that the ear defender can be secured in different positions, it is provided that the holder has a first toothing that cooperates with at least one locking nose and secures the locking positions of the holder relative to the helmet. By means of the locking positions a further adjustment possibility of the relative position of the ear defender relative to the ear of the user in the operative position. Advantageously, the first toothing is formed on a baseplate of the holder and the baseplate has a second toothing that interacts with the inner holder. In this way, a compact configuration with a minimal number of individual parts is achieved.

Advantageously, the securing bracket is shape-stable.

It is provided that the protective headgear combination comprises a face shield that can be arranged in an operative position and an inoperative position on the helmet. Advantageously, the face shield in the inoperative position is outside of the field of vision of the user.

It is known to provide a face shield with a wiremesh or a plastic panel. The plastic panel or the wiremesh in known face shield devices are bent to fit into a holder. The holder prevents return into the original shape. It has been found that as a result of bending a flat plastic panel the optical properties are worsened. In order to provide a face shield device with excellent optical properties it is provided that the face shield has a face shield panel of preshaped plastic material. A face shield panel of preshaped plastic material has excellent optical properties. Even in case of a partial damage of the holder in which the face shield is arranged, the face shield panel does not have the tendency to bend back. i.e., return to a flat panel shape. The embodiment of the face shield of preshaped plastic material constitutes a stand-alone inventive concept.

BRIEF DESCRIPTION OF THE DRAWING

Embodiments of the invention will be explained in the following with the aid of the drawing. It is shown in.

DESCRIPTION OF PREFERRED EMBODIMENTS

Figure 1:
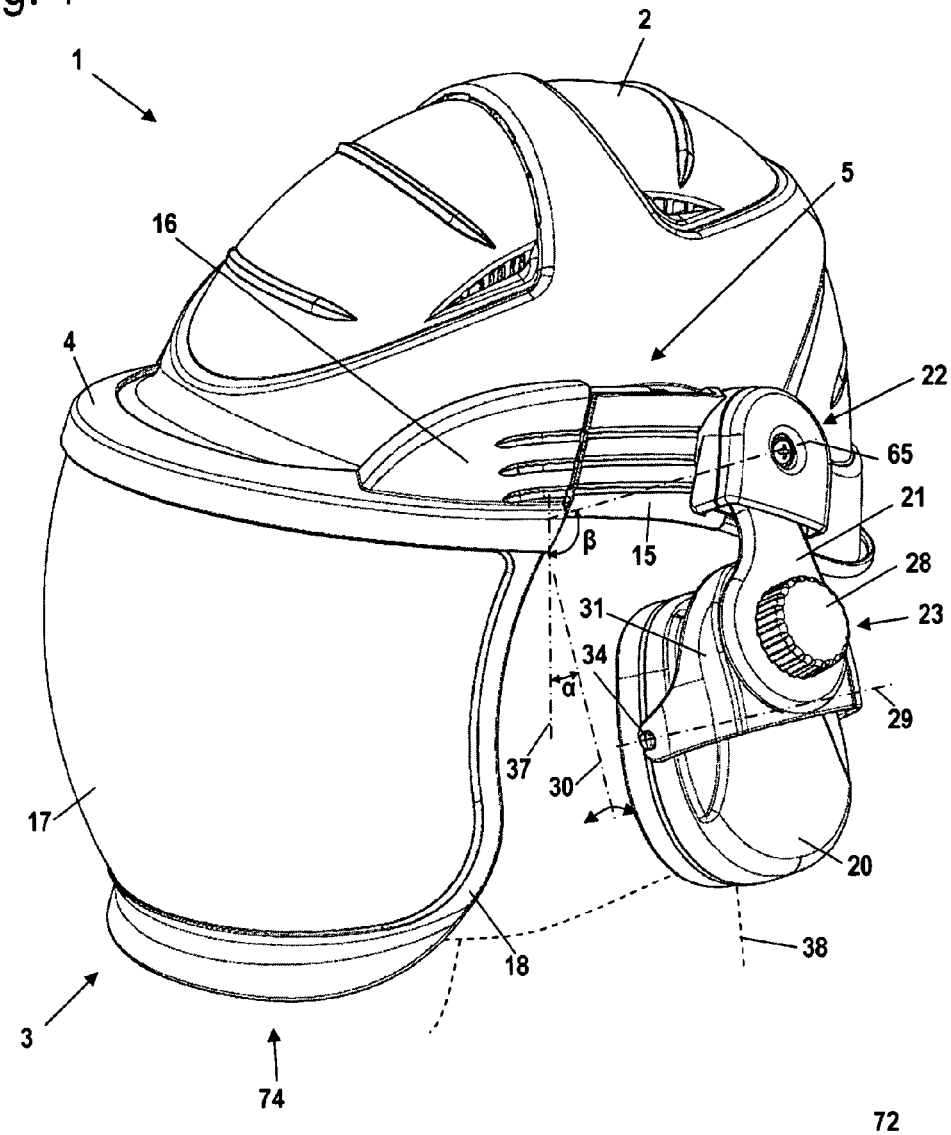
FIG. 1 a perspective illustration of a protective headgear combination.

The protective headgear combination 1 illustrated in FIG. 1 comprises a helmet 2 on which a face shield 3 as well as two ear defenders 20 are secured. Only one of the ear defenders 20 is illustrated in FIG. 1. The face shield 3 is shown in FIG. 1 in its operative position 74 in which the face shield 3 covers the face of a user 38 who is wearing the protective headgear combination 1. The face shield 3 has a securing bracket 4 on which the frame 18 is secured. The frame 18 holds a face shield panel 17. The face shield panel 17 is comprised of preshaped transparent plastic material. Instead of the face shield panel 17 a wiremesh or the like can also be provided. The securing bracket 4 is connected by hinge 5 to the helmet 2. The hinge 5 is completely covered in the outward direction by a cover 16 secured on the holding bracket 4 as well as a cover 15 secured on the helmet 2 and is thus protected from becoming soiled.

The ear defenders 20 are secured by means of a holding bracket 21 on the helmet 2. The holding bracket 21 is comprised of shape-stable material, for example, a shape-stable plastic material. Each ear defender 20 is secured on a securing bracket 21 by means of a spherical bearing 23. The spherical bearing 23 comprises a bearing plate 31 that rests against the securing bracket 21 as well as an operating wheel 28 by means of which a clamping device can be released or tightened. By means of the spherical bearing 23 the bearing plate 31 can be secured in different rotational positions rotated about a first axis of rotation 30 on the securing bracket 21. When a user 38 is wearing the protective headgear combination 1, the first axis of rotation 30 is positioned for an upright head position of the user 38 substantially vertically. Relative to the vertical 37 the first axis of rotation 30 is positioned at an angle $\alpha$ that is smaller than 45°. Advantageously, the angle $\alpha$ is smaller than 30°, in particular smaller than 15°. The spherical bearing 23 enables pivoting of the ear defender 20 about the first axis of rotation 30 and securing of the ear defender 20 in different rotational positions on the securing bracket 21.

Figure 9:
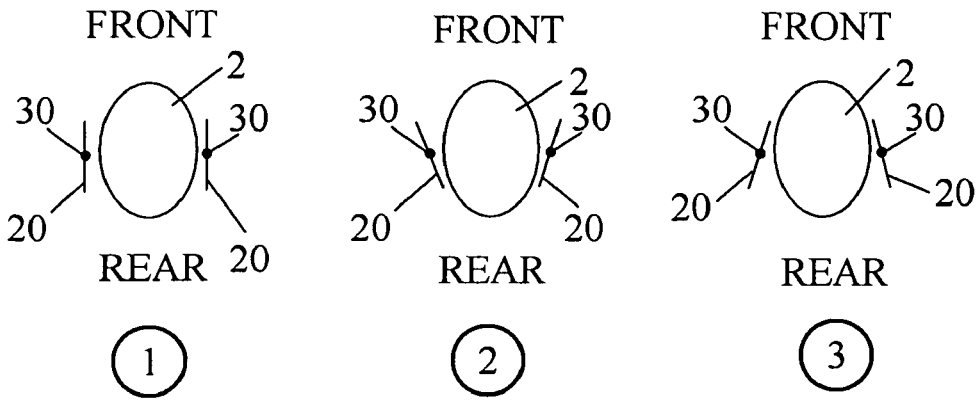
FIG. 9 a schematic top view onto the helmet.

FIG. 9 shows schematically a top view onto a helmet. The axis 30 (symbolized by a black dot) in such a top view extends approximately perpendicular to the paper plane, i.e. penetrates the paper plane. As set forth above, the angle $\alpha$ to the vertical is less than 45° and in particular less than 15°, i.e., the axis 30 is somewhat inclined relative to the paper plane. The ear defenders 20 are indicated schematically as a straight line. Due to the inclined position of the axis 30, in reality the axis 30 that is symbolized by the dot is not in a common plane with the ear defenders 20. Position 1 to the left of FIG. 9 shows the ear defenders 20 in a "neutral" position essentially parallel to a dashed line extending from the front to the rear and cutting the helmet in half. In the position 2, the ear defenders 20 have been pivoted about the axis 30 so that their interior side (cushioned side) is facing forwardly. The position 3 to the right shows the ear defenders rotated to the rear.

Figure 8:
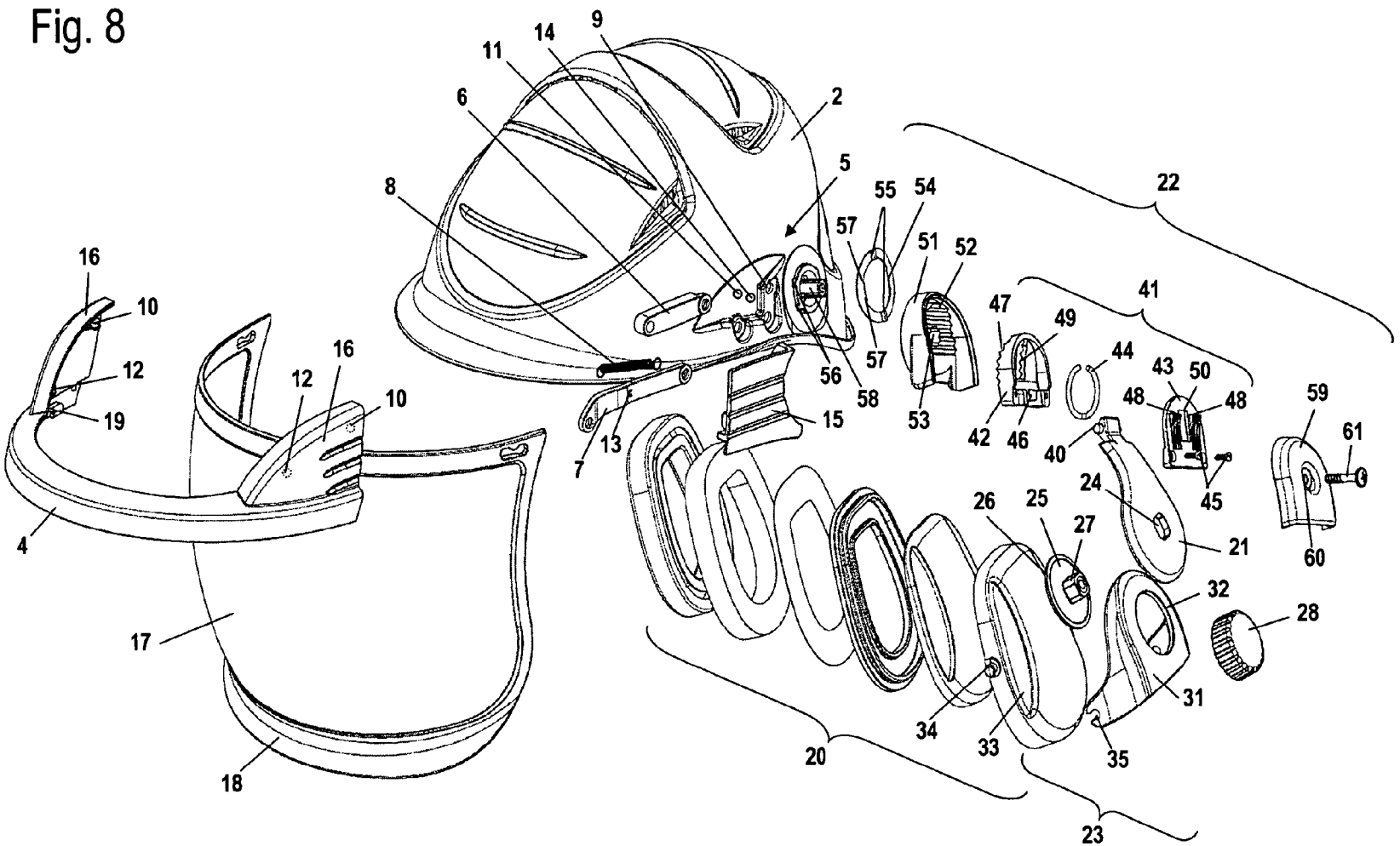
FIG. 8 an exploded illustration of a protective headgear combination.

The ear defender 20 is pivotably supported on the bearing plate 31 so as to pivot about pivot axis 29 that, for an upright head position of the user 38, extends substantially horizontally. For this purpose, the ear defender 20 has two bearing bolts 34 that project into receptacles 35 of the bearing plate 31 (FIG. 8). As shown in FIG. 8, the ear defender 20 has an outer shell 33 on which the bearing bolts 34, of which in the Figures only one is shown, are integrally formed.

On the opposite end the securing bracket 21 is secured by means of holder 22 on the helmet 2. The holder 22 is pivotable relative to the helmet 2 about a second axis of rotation 65. The second axis of rotation 65 is positioned relative to the vertical 37 at an angle β that is greater than 45°. Advantageously, the angle β is approximately 90°. In the embodiment the angle β is somewhat greater than 90°. In particular, the angle β is 75° to 120°.

Figure 2:
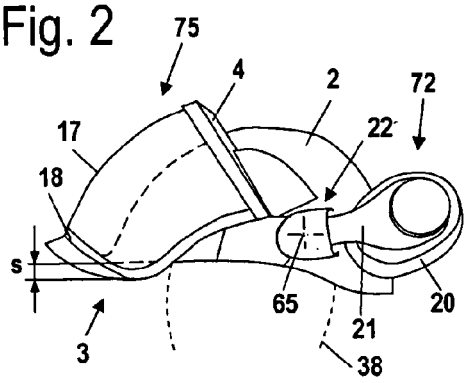
FIG. 2 a schematic side view of a protective headgear combination.

In FIG. 2 the face shield 3 is shown in an inoperative position 75. In this position the face shield 3 is folded upwardly into the area of the helmet 2. The hinge 5 is designed such that the face shield 3 is not within the area of the field of vision of the user 38. Relative to the lower edge of the helmet 2 the face shield 3 has a projecting portion s that is so small that the lower edge of the face shield 3 does not extend into the field of vision of the user 38. The projecting portion is in particular approximately 0.

Figure 3:
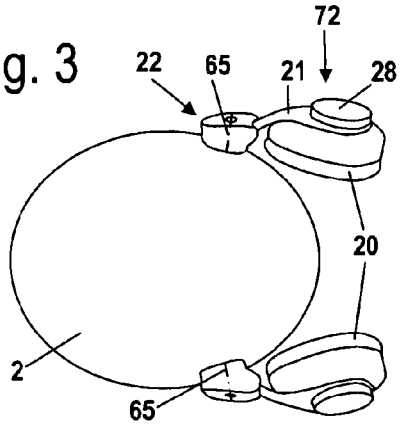
FIG. 3 a schematic plan view of a protective headgear combination.

In FIGS. 2 and 3 the ear defenders 20 are shown in an inoperative position 72. In FIG. 3, for reasons of simplification, the face shield 3 is not illustrated. The ear defenders 20 are pivoted about the second axes of rotation 65 to the rear into the area of the back of the head of the user 38 and are positioned at a spacing relative to the helmet 2. The ear defenders 20 cannot fold against the helmet 2 and cannot become soiled. In this way, soiling of the ear defenders 20 is prevented.

Figure 5:
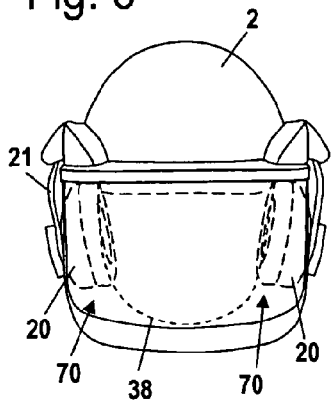
FIG. 5 a schematic front view of a protective headgear combination.

In FIG. 5 the ear defenders 20 are schematically shown in operative position 70. In this position, the ear defenders 20 are spring-loaded toward the head of the user 38 and are forced against the head of the user so that a tight contact is ensured.

Figure 4:
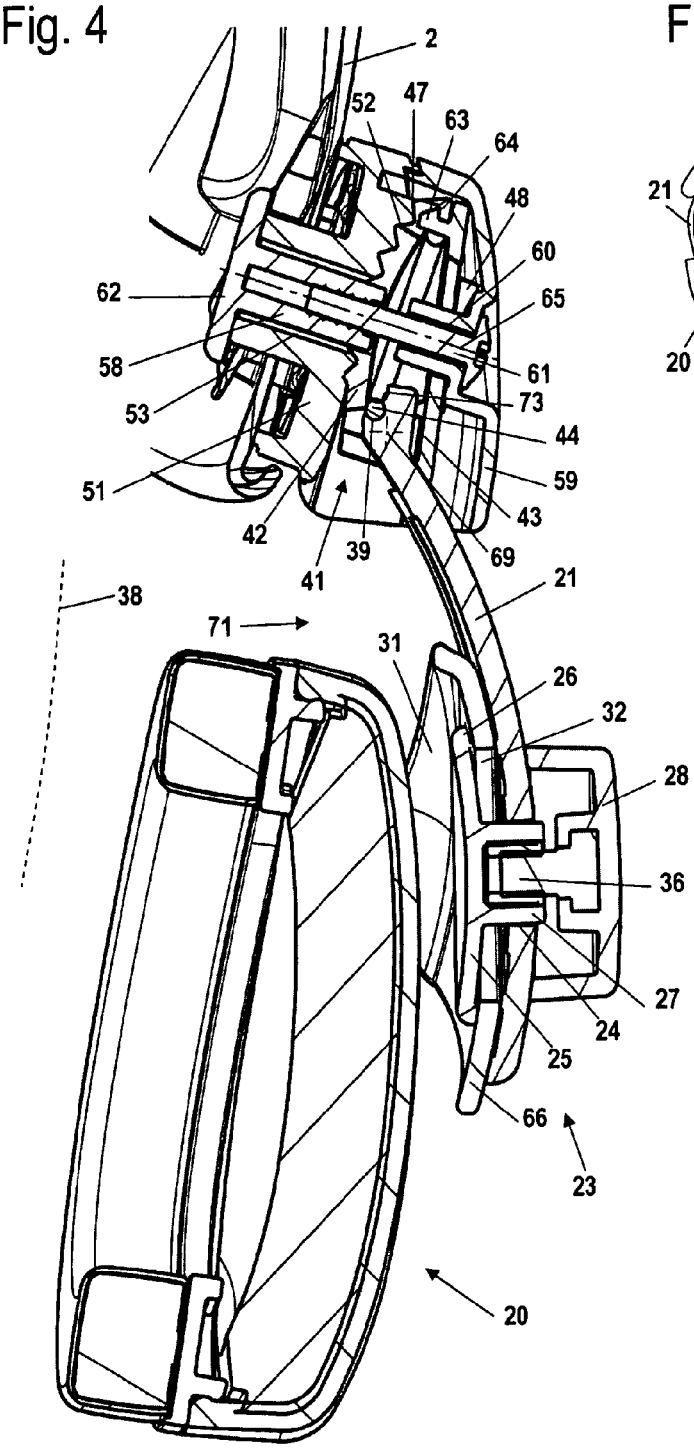
FIG. 4 a detail in a section view of the protective headgear combination of FIG. 1 in the area of the ear defender.

FIG. 4 shows the ear defenders 20 in a rest position 71. In this position the ear defender 20 has a spacing relative to head of the user 38 schematically shown in FIG. 4. In this position the ear defenders 20 shield the ears of the user 38 only minimally so that the user 38 can hear well.

As shown in FIGS. 4 and 8 the spherical bearing 23 has a clamping plate 25 with an edge 26 that projects, as seen by the user, outwardly toward the bearing plate 31. The edge 26 rests against a spherical section 66 of the bearing plate 31. The spherical section 66 of the spherical bearing 23 can be, for example, a section of a surface of a sphere. The spherical section 66 has an opening 32 whose diameter is slightly smaller than the inner diameter of the edge 26 of clamping plate 25. The clamping plate 25 has a threaded socket 27 with an inner thread that projects outwardly through the opening 32. The threaded socket 27 projects through an opening 24 of the securing bracket 21. The threaded socket 27 and the opening 24 are provided with a non-round contour so that the clamping plate 25 cannot be rotated relative to the securing bracket 21. On the securing bracket 21 the operating wheel 23 is arranged that has a threaded bolt 36 that is screwed into the inner thread of the threaded socket 27. The threaded bolt 36 and the threaded socket 27 can be formed by a pressed-in thread or a pressed-in screw or a screw embedded by injection-molding.

The securing bracket 21 in the area of the spherical section 66 is also of a spherical configuration so that the spherical section 66 rests against the securing bracket 21. In order to change the rotational position of the ear defender 20 relative to the securing bracket 21 about the first axis of rotation 30, the operating wheel 28 is rotated and the damping action between the operating wheel 28, the securing bracket 21, the bearing plate 31 and the clamping plate 25 is released. With released clamping action, the bearing plate 31 can be moved relative to the securing bracket 21. The maximum displacement travel is delimited by the inner circumference of the opening 32 against which the threaded socket 27 can rest. In this connection, an adjustment in the longitudinal direction of the securing bracket 21 is possible also. A displacement is possible in all directions defined by the sphere.

The end of the securing bracket 21 facing away from the ear defender 20 is supported on an inner holder 41. The inner holder 41 comprises in inner plate 42 as well as an outer plate 43 that are screwed together by two screws 45. On the side opposite the screws 45 the inner plate 42 and the outer plate 43 can be connected positive-lockingly to one another. For this purpose, the outer plate 43 has a hook 63 that engages behind an edge 64 of the inner plate 42 and in this way connects the inner plate 42 and the outer plate 43 with one another in the direction of the second axis of rotation 65. However, a further screw can also be provided. The inner plate 42 and the outer plate 43 form together a substantially closed housing. Between the inner plate 42 and the outer plate 43 a spring ring 44 is arranged and is open at a side facing away from the securing bracket 21. The spring ring 44 is supported on the sidewalls of the inner plate 42. On the inner plate 42 a receptacle 46 for bearing bolt 40 of the securing bracket 21 is provided with which the securing bracket 42 can be pivoted about the pivot axis 69 shown in FIG. 4 between the operative position 70 and the rest position 71.

As shown in FIG. 4, the spring ring 44 rests against the securing bracket 21. In the rest position 71 shown in FIG. 4 the spring ring 44 is arranged with the area resting against the securing bracket 21 on the inner plate 42. The spring ring 44 is positioned in the rest position 71 in a recess 39 of the securing bracket 21. When the securing bracket 21 is pivoted inwardly toward the user 38 the spring ring 44 is compressed perpendicularly to the pivot axis 69 until the spring ring 44 with its area resting against the securing bracket 21 is positioned outside of the pivot axis 69. In the operative position 70 the spring ring 44 is positioned in a recess 73 that is arranged adjacent to the recess 39. In the operative position 70 the spring ring 44 acts in the opposite direction about the pivot axis 69 and forces the ear defender 20 toward the user 38.

The inner holder 41 is secured between a base plate 51 and a cover plate 59 of the holder 22. In order to enable an adjustability of the securing bracket 21 in the direction of the vertical 37 the inner plate 42 has a slot 49 and the outer plate 43 a slot 50. The slots 49 and 50 extend in a longitudinal direction of the securing bracket 21. Through the slots 49 and 50 a fastening screw 61 projects that secures the holder 22 on the helmet 2 and is screwed into the sleeve 58 illustrated in FIG. 4. The sleeve 58 has a head 62 that rests against the inner side of the helmet 2.

Figure 7:
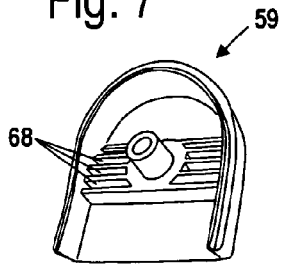
FIG. 7 a perspective illustration of a cover plate of the protective headgear combination of FIG. 1.

The inner plate 42 has a toothing 47. On the outer plate 43 two noses 48 are arranged on either side of the slot 50. The toothing 47 interacts with a second toothing 52 of the base plate 51. The base plate 51 has an opening 53 for the fastening screw 61. The toothings 52 and 47 describe an arc that extends upwardly and outwardly. In this way, the securing bracket 21 upon adjustment in the downward direction is at the same time also adjusted inwardly. In order to keep the spacing between the base plate 51 and the cover plate 59 constant, the outer plate 43 has the two noses 48 that project outwardly and interact with the transverse grooves 68 of the cover plate 59 shown in FIG. 7. The transverse grooves 68 also describe an upwardly and outwardly extending arc. The spacings of the transverse grooves 68 correspond to that of the teeth of toothings 52 and 47. Upon adjusting the inner holder 41 in the downward direction the inner holder 41 is thus forced closer to the base plate 51 while the spacing to the cover plate 59 is enlarged.

Figure 6:
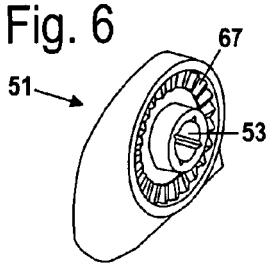
FIG. 6 a perspective illustration of a baseplate of a holder of the protective headgear combination of FIG. 1.

As shown in FIG. 6, the base plate 51 has on its side facing the helmet 2 a toothing 67 that extends annularly about the opening 53. Between the helmet 2 and the base plate 51 a sheet metal ring 54 is arranged that has two oppositely arranged locking noses 55 that interact with toothing 67 of the base plate 51 and define locking positions of the holder 22 relative to the helmet 2 when the holder 22 is pivoted about the second axis of rotation 65. The sheet metal ring 54 has recesses 57 into which the noses 56 of the helmet 2 project so that the sheet metal ring 54 is rotationally fixed on the helmet 2. The cover 59 has an opening 60 through which the fastening screws 61 projects. For adjusting the vertical position of the securing bracket 21 on the helmet 2 the fastening screw 61 is released. As soon as the connection between the base plate 51 and the cover plate 59 has been loosened, the inner holder 41 can be moved relative to the helmet 2 in the longitudinal direction of the securing bracket 21. As soon as the securing bracket 21 has been moved into the desired position, the fastening screw 61 is tightened again. In order to pivot the securing bracket 21 about the axis of rotation 65, release of the fastening screw 61 is not required. As a result of elasticity of the sheet metal ring 54 the holder 22 can be rotated even though the fastening screw 61 is in the tightened position.

In FIG. 8 the hinge 5 is shown in detail. The hinge 5 has a first lever 6 and a second lever 7 that are each secured on helmet 2 and on the securing bracket 4 of the face shield 3. The first lever 6 is secured on fastening point 9 on the helmet 2 and on fastening point 10 on the securing bracket 4. The second lever 7 is longer than the first lever 6 and is secured on a fastening point 11 on the helmet 2 and on a fastening point 12 on the securing bracket 4. The fastening point 11 is arranged, as viewed by the viewer 38, in front of the fastening point 9 of the first lever 6. The fastening point 12 is arranged in front of and below the fastening point 10 of the first lever 6. On the second lever 7 there is a tension coil spring 8 secured on fastening point 13. The other end of the coil spring 8 is arranged on fastening point 14 on the helmet 2. The spring 8 determines the two positions of the face shield 3, i.e., the operative position 74 and the inoperative position 75. On the securing bracket 4 on each side there is a fixation 19 on which the frame 18 of the face shield 17 is secured.

The configuration of the holder 22 as well as of the inner holder 41, in particular the constructive design, represent each, like the configuration of the face shield panel 17 of pre-shaped plastic material, a stand-alone inventive concept that can be provided independent of an adjustability of the rotational position of the ear defender 20 on the securing bracket 21.

What is claimed is:

1. A protective headgear combination comprising:

a helmet;

at least one securing bracket having a first end and a second end, wherein the first end has an inner holder that is connected by a releasable connection to a holder mounted on the helmet;

at least one ear defender secured to the second end of the at least one securing bracket;

wherein the at least one ear defender is rotatable relative to the at least one securing bracket around a first axis of rotation extending approximately parallel to a longitudinal direction of the at least one securing bracket for adjusting a rotational position of the at least one ear defender relative to the at least one securing bracket;

wherein the first axis of rotation is positioned relative to the vertical at an angle ($\alpha$) of less than 45 for an upright head position of a user of the protective headgear combination;

wherein the at least one securing bracket is adjustable in the longitudinal direction relative to the helmet by releasing the releasable connection and moving the inner holder relative to the holder mounted on the helmet in an approximately vertical direction for an upright head position of the user and securing a selected position of the inner holder by securing the releasable connection.

2. The protective headgear combination according to claim 1, wherein the at least one ear defender is pivotably arranged on the securing bracket so as to be pivotable about a pivot axis that is substantially horizontal for an upright head position of the user.

3. The protective headgear combination according to claim 1, wherein the inner holder comprises a toothing that defines different positions of the inner holder relative to the helmet.

4. The protective headgear combination according to claim 1, wherein the securing bracket together with the at least one ear defender is adjustable relative to the helmet between an operative position, in which operative position the at least one ear defender is arranged on the head of the user, and a rest position, in which rest position the at least one ear defender is positioned at a lateral spacing relative to the head of the user.

5. The protective headgear combination according to claim 4, wherein the securing bracket is adjustable from the rest position into an inoperative position, wherein the at least one ear defender in the inoperative position is arranged in the back area of the helmet at a spacing to the helmet.

6. The protective headgear combination according to claim 5, wherein, for reaching the inoperative position, the securing bracket is adjustable about a second axis of rotation, wherein the second axis of rotation is positioned relative to the vertical at an angle ($\beta$) of more than 45° for an upright head position of the user.

7. The protective headgear combination according to claim 6, wherein the holder relative to the helmet is adjustably arranged on the helmet about the second axis of rotation.

8. The protective headgear combination according to claim 7, wherein the holder has a first toothing that interacts with at least one locking nose and determines locking positions of the holder relative to the helmet.

9. The protective headgear combination according to claim 8, wherein the first toothing is formed on a baseplate of the holder and wherein the base plate has a second toothing interacting with the inner holder.

10. The protective headgear combination according to claim 4, wherein the securing bracket is adjustable between the operative position and the rest position relative to the inner holder.

11. The protective headgear combination according to claim 4, comprising a holding device that secures the securing bracket in the operative position and in the rest position.

12. The protective headgear combination according to claim 11, wherein the holding device is arranged in the inner holder.

13. The protective headgear combination according to claim 11, wherein the holding device comprises a spring that is configured as an open spring ring.

14. The protective headgear combination according to claim 1, wherein the securing bracket is shape-stable.

15. The protective headgear combination according to claim 1, comprising a face shield arranged on the helmet so as to be positionable in an operative position and an inoperative position on the helmet.

16. The protective headgear combination according to claim 15, wherein in the inoperative position the face shield is arranged outside of a field of vision of the user.

17. The protective headgear combination according to claim 15, wherein the face shield comprises a face shield panel of pre-shaped plastic material.

18. A protective headgear combination comprising:

a helmet;

at least one securing bracket having a first end and a second end, wherein the first end has an inner holder that is connected by a releasable connection to a holder mounted on the helmet;

at least one ear defender secured by a spherical bearing to the second end of the at least one securing bracket;

wherein the at least one ear defender is rotatable relative to the at least one securing bracket around a first axis of rotation extending approximately parallel to a longitudinal direction of the at least one securing bracket for adjusting a rotational position of the at least one ear defender relative to the at least one securing bracket;

wherein the first axis of rotation is positioned relative to the vertical at an angle ($\alpha$) of less than 45 for an upright head position of a user of the protective headgear combination;

wherein the spherical bearing comprises a bearing plate with a spherical section and a releasable clamping device;

wherein the second end of the securing bracket has a spherically configured part resting on the spherical section of the bearing plate;

wherein the spherical section and the spherically configured part are secured relative to each other when the releasable clamping device is tightened and moveable relative to each other when the releasable clamping device is released;

wherein the rotational position of the at least one ear defender relative to the at least one securing bracket is adjusted by releasing the clamping device and moving the spherical section relative to the spherically configured part about the first axis of rotation and the releasable clamping device is tightened to secure the rotational position of the at least one ear defender relative to the at least one securing bracket.

19. The protective headgear combination according to claim 18, wherein the spherical section of the bearing plate and the spherically configured part of the securing bracket are moveable relative to each other in any direction defined by the spherical section and the at least one ear defender is securable by the clamping device in different positions on the at least one securing bracket.

* * * * *